United States Patent [19]

Umehara

[11] Patent Number: 4,697,560

[45] Date of Patent: Oct. 6, 1987

[54] ROTATING SPEED CONTROL APPARATUS FOR AN INTERNAL COMBUSTION ENGINE

[75] Inventor: Kazuhiro Umehara, Hamamatsu, Japan

[73] Assignee: Suzuki Jidosha Kogyo Kabushiki Kaisha, Shizuoka, Japan

[21] Appl. No.: 797,289

[22] Filed: Nov. 12, 1985

[30] Foreign Application Priority Data

Jan. 31, 1985 [JP] Japan ..... 60-15541

[51] Int. Cl.[4] ..... F02P 11/02; F02P 11/06

[52] U.S. Cl. ..... 123/335; 123/198 DC

[58] Field of Search ..... 123/335, 418, 198 D, 123/198 DC

[56] References Cited

U.S. PATENT DOCUMENTS 3,182,648 5/1965 Schneider et al. ..... 123/335
3,572,302 3/1971 Wollesen ..... 123/335

FOREIGN PATENT DOCUMENTS 2853994 11/1980 Fed. Rep. of Germany ..... 123/335
55-72660 5/1980 Japan .
28868 2/1982 Japan ..... 123/335
57-131820 8/1982 Japan .

*Primary Examiner*—Tony M. Argenbright
*Attorney, Agent, or Firm*—Flynn, Thiel, Boutell & Tanis

[57] ABSTRACT

A rotating speed control apparatus for controlling the rotating speed of an internal combustion engine includes: an ignition circuit of a capacitive discharge ignition (CDI) system; an overspeed preventing circuit having a rotating speed detecting circuit for reducing the rotating speed of the engine to a restricted value in response to an overspeed condition; and a cut-off circuit which temporarily inhibits the control of the engine speed by way of an overspeed prevention inhibiting operation and which is automatically returned to a condition in which it can control the engine speed during restarting of the engine after a stop of the engine. The overspeed preventing circuit is cut off by turning on the cut-off circuit when the engine is driven, so that the overspeed preventing function is inhibited. This cut-off circuit is automatically returned to its off-state when restarting the engine after a stop of the engine, thereby allowing an overspeed of the engine to be prevented.

13 Claims, 6 Drawing Figures

ROTATING SPEED CONTROL APPARATUS FOR AN INTERNAL COMBUSTION ENGINE

FIELD OF THE INVENTION

The present invention relates to a rotating speed control apparatus for an internal combustion engine and, more particularly, to a rotating speed control apparatus of the type which can limit the rotating speed of the internal combustion engine to a restricted value and which can permit a release of the control of the engine speed at a time of emergency, in case of a disaster, to avoid a calamity, or the like.

BACKGROUND OF THE INVENTION

Generally, a method wherein sparks of an ignition apparatus are cut out is used in a rotating speed control apparatus. Ignition apparatuses are mainly classified into a current cut-off system in which the primary energy is stored as magnetic energy by way of the primary current of the ignition coil, and a capacitive discharge ignition (CDI) system in which the primary energy is stored as electrostatic energy when a capacitor is charged to hundreds of volts. In addition, each of the above systems is mainly classified into a magnet ignition type and a battery ignition type in dependence on a difference in the energy source.

In the CDI system, as compared with the current cut-off system, the secondary voltage rapidly rises and the energy discharging time is short. Thus, the CDI system has as features that: the load characteristic to the leakage resistance due to a strain or damage of the plug is good; the charging time of the capacitor can be reduced; degradation in performance upon high-speed operation is small, and the like. Accordingly, this CDI system is frequently used for a racing car or a two-wheeled vehicle.

In a conventional rotating speed control apparatus for an internal combustion engine, there has been proposed the addition of a release apparatus for inhibiting the control of the engine rotating speed by an overspeed preventing circuit (Japanese Patent Application Laid-Open No. 72660/1980), as shown in FIGS. 3, 4A and 4B of the present application. Practically speaking, respective terminals of an ignition circuit of the CDI system serving as a part of an ignition apparatus are arranged on a base board 130 so as to lie in two vertical lines, as shown in FIG. 3. Terminals A and B of an overspeed preventing circuit are normally connected by way of a short-circuit plate 132 as shown in FIGS. 3 and 4A. To inhibit the control of the rotating speed of the engine by the overspeed preventing circuit, the attaching position of the plate 132 is shifted to the left to thereby open the circuit, as indicated by broken lines in FIG. 3 and as shown in FIG. 4B.

However, this method has drawbacks, including the fact that it is necessary to detach the terminals fixing the short-circuit plate in order to move it, which takes a long time and is troublesome, so that it could take too long in the event of emergency. There is also another drawback in that it is impossible to release the plate from the driver's seat or the like by way of a remote control operation.

Further, when the rotating speed of the engine is to again be controlled by the overspeed preventing circuit, it is necessary to manually shift the short-circuit plate back to its original position after removing the terminals and to then fix this plate in position with the terminals, which takes a long time, like the release. Consequently, once the speed control has been inhibited, the replacement of the short-circuit plate is troublesome and there is thus a risk that it will not be replaced and the engine will subsequently be used in the state where overspeed projection is inhibited, even in a case where there is no need to inhibit the speed control and the control of the engine speed by way of the overspeed preventing circuit might have been purposely stopped.

SUMMARY OF THE INVENTION

It is an object of the present invention to provide a rotating speed control apparatus for an internal combustion engine which includes a cut-off circuit for inhibiting the prevention of overspeed of the engine and for enabling control of the engine speed when the engine is restarted after a stop, thereby making it possible to improve the operating efficiency of the disabling of the overspeed prevention, while at a restart of the engine this cut-off circuit is automatically returned to a condition enabling an overspeed of the engine to be prevented.

This object is accomplished by providing a rotating speed control apparatus for controlling the rotating speed of an internal combustion engine, including: an ignition circuit of a CDI system; an overspeed preventing circuit having a rotating speed detecting circuit for controlling the rotating speed of the engine to a restricted value in response to an overspeed condition; and a cut-off circuit which can temporarily disable the control of the engine speed due to the overspeed prevention circuit and which is automatically returned during a restart of the engine to a condition in which it can control the engine speed.

According to the present invention, by turning on the cut-off circuit when the engine is driven, the overspeed preventing circuit is cut off, so that overspeed prevention is inhibited. At the restart of the engine after a stop, the cut-off circuit is automatically returned to an off-state in which it allows overspeed prevention of the engine to be performed.

The present invention will be apparent from the following detailed description, taken in conjunction with the accompanying drawings.

DETAILED DESCRIPTION OF THE PREFERRED EMBODIMENTS

Embodiments of the present invention will now be described in detail with reference to the drawings.

Figure 1:
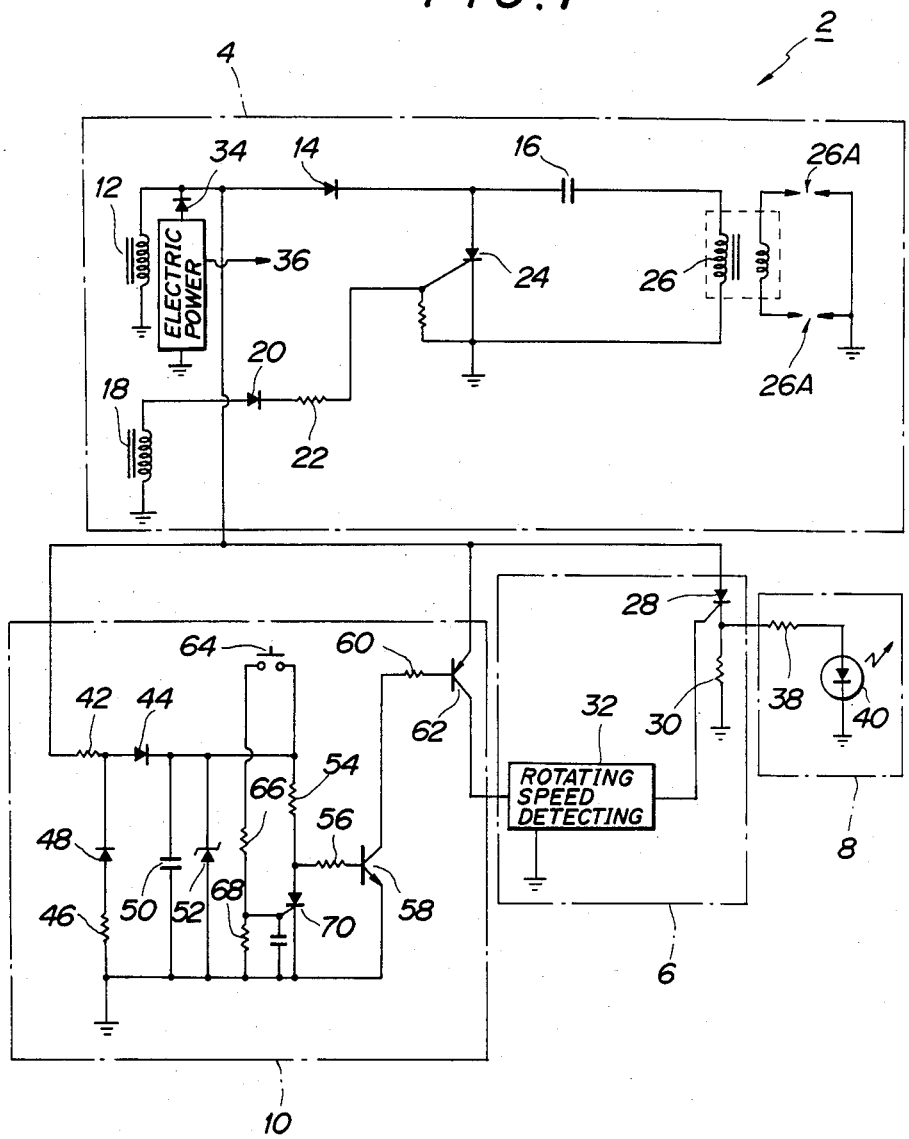
FIG. 1 is a schematic circuit diagram of a rotating speed control apparatus for an internal combustion engine according to a first embodiment of the present invention.

FIG. 1 shows a first embodiment of the invention. In FIG. 1, reference numeral 2 denotes a control circuit for a rotating speed control apparatus of an internal combustion engine. The control circuit 2 comprises: an ignition circuit 4 of the CDI system based on the magnet type; an overspeed preventing circuit 6; a spark extinction state indicating circuit 8; and a cut-off circuit 10 to cut off the overspeed preventing circuit 6.

In the ignition circuit 4, an output of a capacitive charging coil 12 is rectified by a diode 14 and charges a capacitor 16. A gate voltage generated in a pulser coil 18 is applied to a gate of a thyristor 24 through a diode 20 and a resistor 22, so that the charge in the capacitor 16 is periodically discharged and a current flows through an ignition coil 26, thereby causing a spark to be generated at respective spark plugs 26A.

The overspeed preventing circuit 6 will now be explained. This preventing circuit comprises: a thyristor 28; a resistor 30; and a rotating speed detecting circuit 32 to turn on or off the thyristor 28. The anode of the thyristor 28 is connected to the charging coil 12 provided in the ignition circuit 4, while the cathode is connected to ground through the resistor 30. An output terminal of the rotating speed detecting circuit 32 is connected to the gate of the thyristor 28. The rotating speed detecting circuit 32 receives the output of the coil 12 and supplies current to the gate of the thyristor 28 when the rotating speed of the engine enters an overspeed state, or in other words when the speed is in excess of a predetermined rotating speed. The thyristor 28 short-circuits the coil 12 in the ignition circuit 4 due to this gate current, so that the spark plug does not generate a spark and accordingly the engine speed is controlled to be less than the predetermined rotating speed. Numeral 34 denotes a diode, and 36 a power supply line for the detecting circuit 32.

In addition, the spark extinction state indicating circuit 8 is connected between the thyristor 28 and the resistor 30 of the overspeed preventing circuit 6. The circuit 8 consists of a light emitting diode 40 having its anode connected through a resistor 38 to the cathode of the thyristor 28 and having its cathode grounded.

The cut-off circuit 10 will now be explained. In a case where overspeed prevention is not inhibited, the cut-off circuit 10 receives the output of the charging coil 12. This output flows through a resistor 42, a diode 44, a resistor 46, and a diode 48, so that current is supplied to a capacitor 50 and a Zener diode 52. The current flows through resistors 54 and 56 to a transistor 58, thereby turning on the transistor 58 and further turning on a transistor 62 through a resistor 60. In this case, the engine speed is controlled to a predetermined rotating speed by allowing a current to flow from the coil 12 through the transistor 62 to the rotating speed detecting circuit 32.

On the other hand, for example, a reset switch 64 is provided to inhibit the overspeed preventing function. By turning on the reset switch 64, or in other words closing it, current flows through the diode 44, reset switch 64, and resistors 66 and 68 to ground, so that a thyristor 70 is turned on due to the voltage drop across the resistor 68. The reset switch 64 is a normally opened type contact in which it is manually operated and automatically returns. Namely, this switch is constituted so as to always keep the OFF state excluding the time when it is manually operated. When the thyristor 70 is turned on, the base and emitter of the transistor 58 are short-circuited, so that the transistors 58 and 62 are also turned off. Thus, the overspeed preventing circuit 6 is cut off and the overspeed preventing function is inhibited.

When the engine is stopped, the thyristor 70 is turned off and inhibiting of overspeed prevention is stopped. When the engine is restarted, the cut-off circuit 10 is automatically returned to its original state. In this manner, control of the engine speed by way of the overspeed preventing circuit is performed.

The operation of the rotating speed control apparatus in this embodiment will now be explained.

When a magnet rotor (not shown) which is rotated synchronously with a crankshaft (not shown) is rotated, electromagnetic forces are generated in the charging coil 12 and pulser coil 18, so that the engine is driven by the ignition circuit 4.

Current flows to the detecting circuit 32 from the output of the coil 12 through transistor 62. When the engine speed enters the overspeed state in excess of the predetermined rotating speed, the turn-on voltage of the thyristor 28 is applied between the gate and the cathode thereof, so that the thyristor 28 is turned on. The turn-on of the thyristor 28 results in a short-circuit from the coil 12 through thyristor 28 and resistor 30 to ground. The output of the coil 12 does not charge the capacitor 16 in this short-circuited state. Thus, no output is supplied to the ignition coil 26, and no spark is generated at the spark plugs 26A. A current flows through the thyristor 28 in this state, producing a voltage which is divided by the resistors 30 and 38 and is applied to the light emitting diode 40, so that the diode 40 is lit. In this way, it is visually indicated that the overspeed preventing operation is being executed.

When the thyristor 28 is turned on and the output of the coil 12 is short-circuited, the coil output is not inputted to the detecting circuit 32 through transistor 62 and the detecting operation is stopped, so that the thyristor 28 is turned off and the ignition operation is carried out in the ordinary state. In this way, ignition and spark extinction are alternately repeated.

In the ordinary state, current is flowing through the cut-off circuit 10 to turn on the transistor 62. In this state, when overspeed prevention is inhibited, in other words when the reset switch 64 is temporarily turned on, the current after the constant voltage circuit flows sequentially through the diode 44, reset switch 64, and resistors 66 and 68 to ground. The voltage applied to the gate of the thyristor 70 is defined by the voltage drop across the resistor 68, so that the thyristor 70 is turned on and the base and emitter of transistor 58 are short-circuited. Thus, no current flows to the base of the transistor 58 and this transistor is turned off. When the transistor 58 is turned off, base current to the transistor 62 similarly does not flow, so that the transistor 62 is turned off. Thus, no current flows to the detecting circuit 32 through transistor 62 and the control of the engine speed for prevention of overspeed of the engine is not performed at all. Consequently, even if the engine speed exceeds the predetermined rotating speed, sparks will not be extinguished. As mentioned above, the reset switch 64 is temporarily turned on due to the manual operation. After completion of the manual operation, the switch 64 automatically returns from the ON state so as to keep the OFF state (namely, the normally opened state). Due to this, when the engine is started or restarted, the reset switch 64 is always in the OFF state, so that the start and restart of the engine can be performed.

When the engine is stopped, no power is supplied; therefore, the thyristor 70 is apparently turned off and inhibiting of overspeed prevention is stopped. When starting or restarting the engine, the overspeed preventing function is normally made operative.

In the foregoing embodiment, overspeed prevention is enabled and disabled by the reset switch 64. However, for example, the overspeed preventing function can also be controlled by use of a push button switch in such a manner that this function is made operative only so long as this switch is manually pressed by a finger.

With this apparatus of the first embodiment, the operating effeciency of an overspeed prevention inhibiting operation can be improved and emergency refuge in the case of a disaster, or calamity avoidance or the like, can be rapidly achieved, so that this apparatus is practically advantageous.

Moreover, the overspeed prevention inhibiting operation is automatically returned to an overspeed preventing function by restarting the engine after it was stopped. Therefore, there is no need to carry out the attaching or detaching operation of a short-circuit plate, which operation has been required to date in conventional arrangements, and the inventive apparatus is convenient to use.

Figure 2:
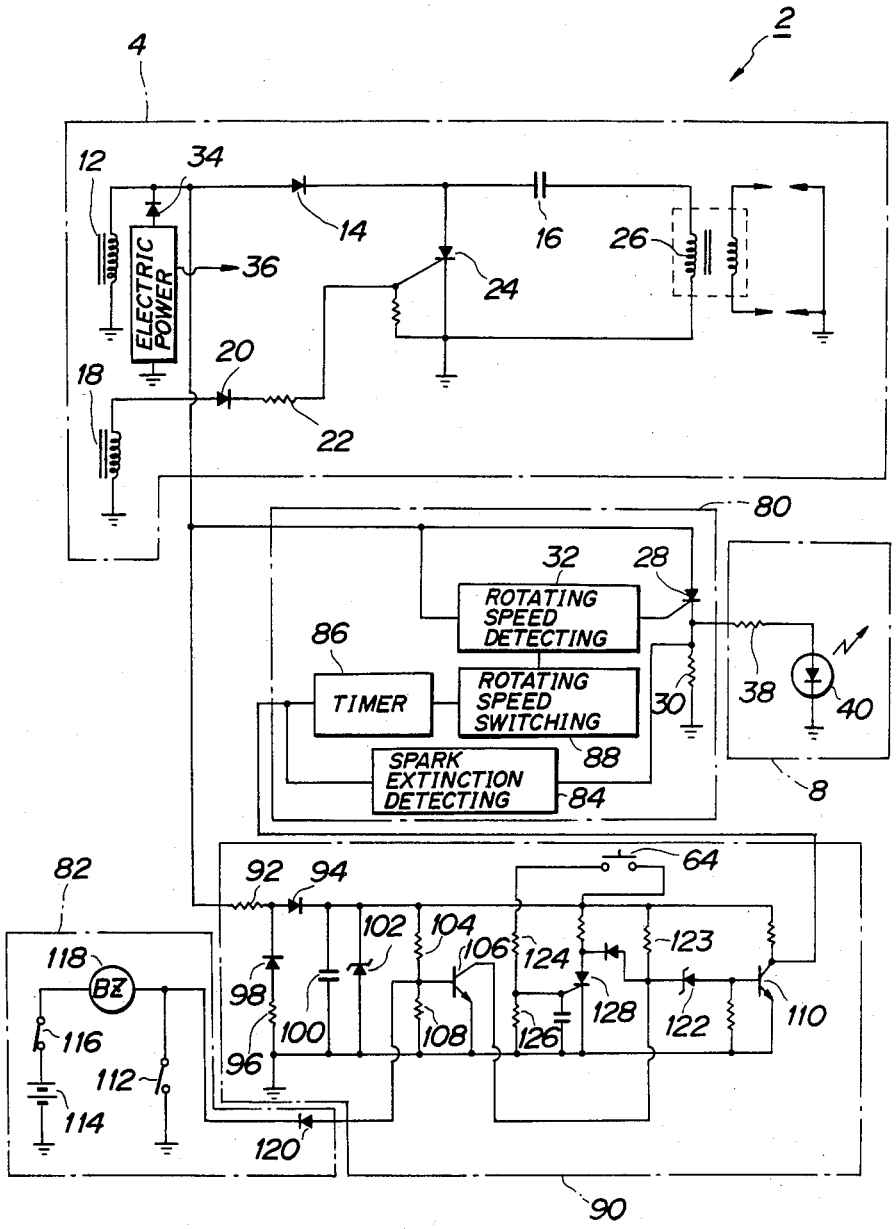
FIG. 2 is a schematic circuit diagram of a rotating speed control apparatus for an internal combustion engine according to a second embodiment of the invention.
Figure 3:
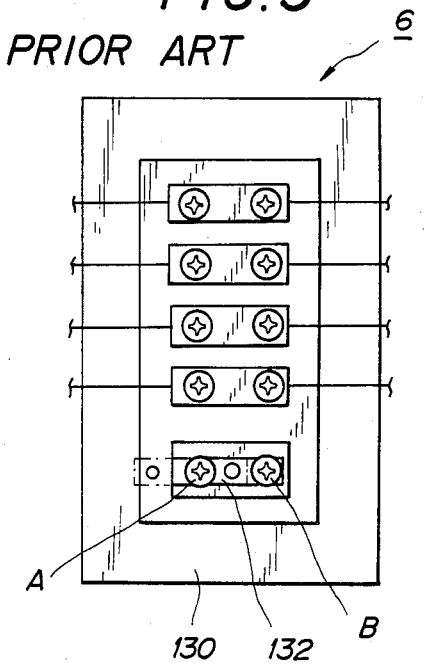
FIG. 3 PRIOR ART
FIG. 3 is a top view of the terminal portion of a conventional ignition circuit.
Figure 4A:
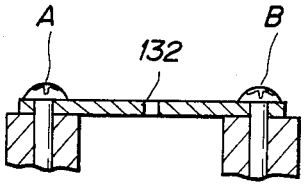
FIG. 4A PRIOR ART
FIGS. 4A and 4B are sectional views respectively showing the connection state and the cut-off state of a short-circuit plate in the conventional ignition circuit terminal portion of FIG. 3.
Figure 4B:
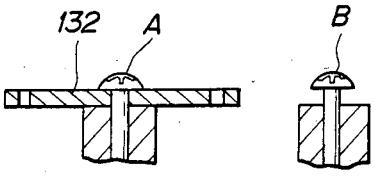
FIG. 4B PRIOR ART
Figure 5:
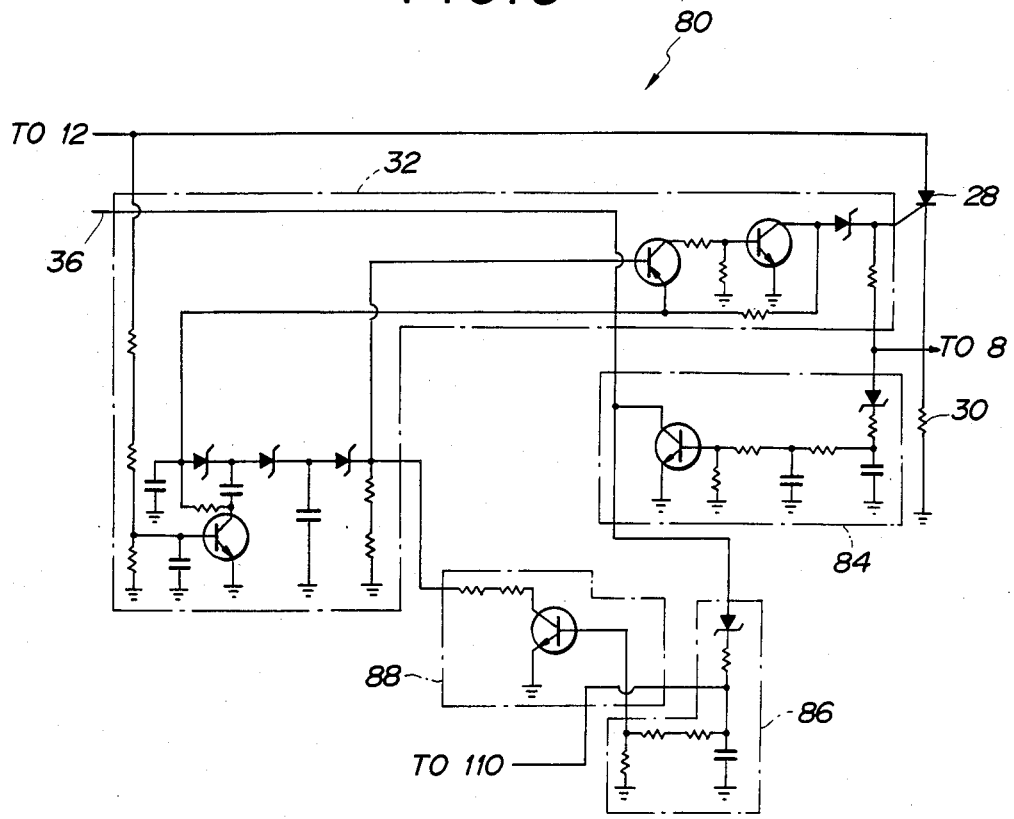
FIG. 5 is a schematic circuit diagram of a portion of the circuitry of FIG. 2 which is shown in FIG. 2 as labeled rectangular boxes.

FIG. 2 shows a second embodiment of the present invention. In the second embodiment, parts and components which have the same functions as those in the first embodiment are designated by the same reference numerals and no detailed explanation is made.

A feature of the second embodiment is that there are provided an overspeed preventing circuit 80 to switch the rotating speed of the engine to a low speed when the engine is continuously driven at a set rotating speed for a predetermined period of time, and an oil detecting circuit 82 to monitor the quantity of lubricating oil for the engine and to generate a warning if a problem is detected.

Practically speaking, the overspeed peventing circuit 80 comprises: the thyristor 28; the resistor 30; the rotating speed detecting circuit 32; a spark extinction detecting circuit 84 to detect the spark extinction state; a timer circuit 86 to measure the spark extinction time; and a set rotating speed switching circuit 88 to switch the set rotating speed of the engine to a low speed when the timer circuit 86 detects that the spark extinction state has continued for a predetermined period of time.

In a case where overspeed prevention is not inhibited, a cut-off circuit 90 receives the output from the capacitive charging coil 12. A current flows through a resistor 92, a diode 94, a resistor 96, and a diode 98, so that current is supplied to a capacitor 100 and a Zener diode 102. Then, the current flows through a resistor 104 and a transistor 106, thereby turning on the transistor 106. In addition, the circuit between a resistor 108 and the transistor 106 becomes conductive, and a transistor 110 is turned off.

In this case, if the quantity of lubricating oil in the oil tank decreases below a predetermined minimum level, an oil level switch 112 in the overspeed preventing circuit 80 is turned on, and current flows from a battery 114 through an ignition switch 116, a buzzer 118, and the oil level switch 112, so that the buzzer 118 rings. Also, the base and emitter of the transistor 106 are short-circuited through a diode 120 to turn off the transistor 106, thereby allowing current to flow through a resistor 123, a Zener diode 122, and the base and emitter of the transistor 110, so that the transistor 110 is turned on. The input to the timer circuit 86 is short-circuited by the transistor 110, and the timer circuit 86 is thus made operative.

The overspeed preventing function is inhibited in the following manner. When overspeed prevention, namely restriction of the rotation speed, is not performed, for instance when the reset switch 64 is turned on, current from the constant voltage circuit section flows through the reset switch 64 and resistors 124 and 126 to ground, thereby allowing the thyristor 128 to be turned on due to the voltage drop across the resistor 126. This turn-on of the thyristor 128 causes the base and emitter of the transistor 110 to be short-circuited, so that the transistor 110 is turned off. Then, the input to the timer circuit 86 is disabled. In this way, the overspeed preventing function, namely rotation restriction is inhibited.

When the engine is stopped, rotation restriction inhibiting is stopped, as in the first embodiment. Upon restarting the engine, this inhibiting operation is automatically returned to a condition in which rotation restriction is enabled.

The operation of the rotating speed control apparatus of the second embodiment will now be explained.

When the engine speed increases and reaches a preset rotating speed, a voltage is applied to the gate of the thyristor 28 by the detecting circuit 32 and the thyristor 28 is turned on, thereby allowing the output of the coil 12 to be short-circuited and causing the spark to be extinguished. This spark extinction state is detected by the detecting circuit 84 and the timer circuit 86 is made operative. When the timer circuit 86 has measured the elapse of a predetermined interval of time, the rotating speed switching circuit 88 is made operative, so that the preset rotating speed for restriction of rotation is switched to a lower value. Practically speaking, for instance, when it is assumed that the first and second set rotating speeds are respectively 6000 rpm and 3000 rpm and that the preset time of the timer circuit 86 is 15 seconds, the rotation restricting operation is started when the engine speed reaches 6000 rpm. Thus, spark extinction and ignition operations are alternately repeated: spark extinction→ignition→spark extinction, etc. In this way, an increase in engine speed is suppressed. However, if this spark extinction state has continued for fifteen seconds, the rotating speed of the engine is switched to the second set speed of 3000 rpm by the switching circuit 88.

As described above, the generation of abnormal vibrations in the engine due to the repetitive spark extinction and ignition operations is prevented after a preset time interval, and durability of the engine can be maintained.

Further, the driver is actively informed of the spark extinction state, thereby making it possible to prevent the occurrence of various accidents as much as possible.

In the oil detecting circuit 82, the oil level switch 112 is turned on in response to reduction in the quantity of oil below a predetermined amount, thereby allowing the buzzer 118 to ring. In addition, current flows through the resistor 130, Zener diode 122, and base and emitter of the transistor 110, so that the transistor 110 is turned on. This turn-on of the transistor 110 causes the input to the timer circuit 86 to be grounded by the transistor 110. Thus, the timer circuit 86 starts operating and, after expiration of the et time, for example fifteen seconds, causes the circuit 88 to switch the engine speed to the second set rotating speed of 3000 rpm.

To inhibit rotation restriction at the time of an emergency, the reset switch 64 is instantaneously turned to an on state, whereby rotation restriction is not performed. Thus, current flows through the reset switch 64 and resistors 124 and 126 to ground. The current flows to the gate of the thyristor 128 due to the voltage drop across the resistor 126, so that the thyristor 128 is turned on. The base side of the transistor 110 is short-circuited and no current flows through the base, so that the transistor 110 is turned off. This turn-off of the transistor 110 causes the input of the timer circuit 86 to be disabled, thereby allowing the rotation restriction to be inhibited.

This rotation restriction inhibiting state continues until the engine stops. When the engine is stopped, no power is supplied and the thyristor 128 is turned off. Therefore, when the engine is then restarted without supplying more oil, the transistor 110 is turned off, rotation restriction is started, and simultaneously the buzzer 118 rings.

Thus, when the oil quantity decreases and rotation restriction is enabled, rotation restriction can be temporarily released in an emergency. Therefore, this apparatus of the second embodiment is practically advantageous.

The present invention is not limited to the foregoing first and second embodiments, because modifications and variations are possible within the spirit and scope of the appended claims of the invention.

For example, in the second embodiment of the invention, only rotation restriction is inhibited by the turn-on of the reset switch. However, inhibiting rotation restriction and stopping the ringing of the buzzer may be simultaneously performed.

In addition, the rotating speed control apparatus of the invention may be implemented by both circuit arrangements in the first and second embodiments of the invention and either one of them may be exchanged and used as necessary.

Further, the capacitive charging coil of the magnet type is used as a power source for the inhibiting circuit in the first and second embodiments of the present invention. Ihe electric power consumption of such an inhibiting circuit is so small that it does not adversely influence the voltage required for ignition. However, a battery may alternatively be used as a power source for the inhibiting circuit.

As described above in detail, according to the present invention, rotation restriction can be almost instantaneously performed by way of a simple operation and the operating efficiency can be improved. In addition, the rotation restricting capability can be automatically reinstated upon restarting the engine after a stop of the engine, so that there is not a risk that the engine is used with the rotation restriction inhibited upon restarting the engine. Moreover, an ignition coil can be used as a power source for the circuit to temporarily inhibit rotation restriction, and this coil can be used in the engine without a battery. If an oil detecting circuit for detecting the oil quantity and allowing the buzzer or the like to generate a warning is used together with the overspeed preventing circuit, the driver can freely select whether only the rotation restriction is inhibited or whether both the rotation restriction and the buzzer are simultaneously inhibited.

The embodiments of the invention in which an exlusive property or privilege is claimed are defined as follows:

1. A rotating speed control apparatus for controlling the rotating speed of an internal combustion engine, comprising:

a capacitive discharge ignition circuit;

rotating speed detecting circuit means for monitoring the rotating speed for the engine;

overspeed preventing circuit means cooperable with said capacitive discharge ignition circuit and responsive to said rotatiing speed detecting circuit means for causing said capacitive discharge ignition circuit to limit the rotating speed of the engine when said rotating speed detecting circuit means indicates that the engine is attempting to exceed a first predetermined speed; and independently manually actuable cut-off circuit means for disabling said overspeed preventing circit means so as to prevent said overspeed preventing circuit means from limiting the rotating speed of the engine;

wherein said cut-off circuit means includes a reset switch and is actuated in response to manual actuation of said reset switch;

wherein said reset switch is a momentary push button switch;

wherein following manual actuation of said momentary push button switch said cut-off circuit means remains continuously actuated until the engine is stopped, and wherein at a subsequent restart of the engine said cut-off circuit means is deactuated;

wherein said ignition circuit includes a capacitive charging coil;

wherein said push button switch has first and second terminals; and wherein said cut-off circuit means includes: a thyristor having its cathode connected to ground; a first resistor having a first end connected to the anode of said thyristor and having a second end connected to said first terminal of said push button switch; a second resistor having a first end connected to said second terminal of said push button switch; a third resistor having a first end connected to a second end of said second resistor and having a second end connected to ground; a capacitor having a first end connected to ground and having a second end connected to a gate of said thyristor and to said first end of said third resistor; first means electrically coupling said capacitive charging coil of said ignition circuit to said first terminal of said push button switch; and second means electrically coupling said anode of said thyristor to said overspeed preventing circuit means.

2. The apparatus according to claim 1, wherein said first means includes: a first diode having its anode connected to ground and its cathode connected to said first terminal of said push button switch; a capacitor having a first end connected to ground and a second end connected to said first terminal of said push button switch; a second diode having its cathode connected to said first terminal of said push button switch; a fourth resistor having first end connected to the anode of said second diode and a second end coupled to said capacitive charging coil; a third diode having its cathode connected to the anode of said second diode; and a fifth resistor having a first end connected to the anode of said third diode and a second end connected to ground; and wherein said first diode is zener diode.

3. A rotating speed control apparatus for controlling the rotating speed of an internal combustion engine, comprising:

a capacitive discharge ignition circuit;

rotating speed detecting circuit means for monitoring the rotating speed of the engine;

overspeed preventing circuit means cooperable with said capacitive discharge ignition circuit and responsive to said rotating speed detecting circuit means for causing said capacitive discharge ignition circuit to limit the rotating speed of the engine when said rotating speed detecting circuit means indicates that the engine is attempting to exceed a first predetermined speed; and independently manually actuable cut-off circuit means for disabling said overspeed preventing circuit means so as to prevent said overspeed preventing circuit means form limting the rotating speed of the engine;

wherein said overspeed preventing circuit means includes timer means for measuring a predetermined interval of time after said overspeed preventing circuit means begins limiting the speed of the engine, said overspeed preventing circuit means limiting the speed of the engine to said first predetermined speed during said predetermined time interval and thereafter limiting the speed of the engine to a second predetermined speed which is less than said first predetermined speed.

4. The apparatus according to claim 3, wherein said cut-off circuit means includes a reset switch and is actuated in response to manual actuation of said reset switch.

5. The apparatus according to claim 4, wherein said reset switch is a momentary push button switch.

6. The apparatus asccording to claim 5, wherein said cut-off circuit means is actuated only so long as said momentary push button switch is actuated.

7. The apparatus according to claim 5, wherein following manual actuation of said momentary push button switch said cut-off circuit means remains continuously actuated until the engine is stopped, and wherein at a subsequent restart of the engine said cut-off circuit means is deactuated.

8. The apparatus according to claim 3, including indicating means responsive to said overspeed preventing circuit means for indicating that the rotating speed of the engine is being limited.

9. The apparatus according to claim 8, wherein said indicating means includes a light emitting diode.

10. The apparatus according to claim 3, including a buzzer which buzzes when said overspeed preventing circuit means is limiting the speed of the engine.

11. The apparatus according to claim 3, including level switch means responsive to the level of a fluid in the engine and coupled to said timer means for actuating said timer means when the fluid drops below a predetermined minimum level, said overspeed preventing circuit means being responsive to said timer means for limiting the speed of the engine to said second predetermined speed when the level of the fluid has been below said predetermined minimum level for said predetermined interval of time.

12. The apparatus according to claim 11, including buzzer means responsive to said level switch means for producing a buzzing sound whenever the level of the fluid is below said predetermined minimum level.

13. The apparatus according to claim 3, wherein said capacitive discharge ignition circuit produces electrical voltage pulses which are successively applied to a spark plug of the engine, and wherein said overspeed preventing circuit means limits the speed of the engine by suppressing selected said electrical voltage pulses.

* * * * *